US010224647B2

(12) United States Patent
Hamada et al.

(10) Patent No.: US 10,224,647 B2
(45) Date of Patent: Mar. 5, 2019

(54) WIRE WITH A CRIMPED TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroshi Hamada, Mie (JP); Satoshi Morikawa, Mie (JP); Takehiro Nakata, Mie (JP); Takuji Otsuka, Mie (JP); Takanobu Shimada, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/556,013

(22) PCT Filed: Feb. 16, 2016

(86) PCT No.: PCT/JP2016/054365
§ 371 (c)(1),
(2) Date: Sep. 6, 2017

(87) PCT Pub. No.: WO2016/143466
PCT Pub. Date: Sep. 15, 2016

(65) Prior Publication Data

US 2018/0062277 A1 Mar. 1, 2018

(30) Foreign Application Priority Data

Mar. 6, 2015 (JP) ..... 2015-044589

(51) Int. Cl.
*H01R 4/18* (2006.01)

(52) U.S. Cl.
CPC ..... *H01R 4/185* (2013.01)

(58) Field of Classification Search
CPC ..... H01R 4/185; H01R 4/188; H01R 4/4818
(Continued)

(56) References Cited

U.S. PATENT DOCUMENTS 3,404,368 A * 10/1968 Lincoln ..... H01R 4/185 439/848
3,831,132 A * 8/1974 Bowden, Jr. ..... H01R 4/185 439/442

(Continued)

FOREIGN PATENT DOCUMENTS

| | | |
|---|---|---|
| JP | 2002-190347 | 7/2002 |
| JP | 3112143 | 6/2005 |
| JP | 2010-102853 | 5/2010 |

OTHER PUBLICATIONS

International Search Report dated Mar. 15, 2016.

*Primary Examiner* — Tulsidas C Patel
*Assistant Examiner* — Travis Chambers
(74) *Attorney, Agent, or Firm* — Gerald E. Hespos; Michael J. Porco; Matthew T. Hespos

(57) ABSTRACT

A wire with terminal includes a wire in which a core is covered with a coating, and a terminal 20 including a wire barrel 24 to be crimped to the core exposed from the coating of the wire and an insulation barrel 26 to be crimped to the coating of the wire. The wire is pulled rearwardly from the terminal. Recesses 26B are provided on a surface of the insulation barrel 26 to be crimped and openings of the recesses 26B are shaped to become narrower toward a rear side. As the wire is pulled more rearwardly, the coating penetrating into the recesses 26B moves rearwardly of the
(Continued)

recesses 26B to be compressed and hardened and becomes less likely to come out of the recesses 26B. Thus, impact strength can be enhanced.

4 Claims, 6 Drawing Sheets

(58) Field of Classification Search
USPC ..... 439/865, 873, 877, 878, 882
See application file for complete search history.

(56) References Cited

U.S. PATENT DOCUMENTS 6,206,727 B1 * 3/2001 Aoyama ..... H01R 9/0518 439/424
6,554,644 B2 * 4/2003 Koide ..... H01R 9/0518 439/108
8,052,466 B2 * 11/2011 Okamoto ..... H01R 4/184 439/585
8,485,853 B2 * 7/2013 Seifert ..... H01R 4/188 439/882
8,616,928 B2 * 12/2013 Uchiyama ..... H01R 4/184 439/877
8,622,776 B2 * 1/2014 Morikawa ..... H01R 4/185 439/883
8,758,054 B2 * 6/2014 Miyawaki ..... H01R 4/185 439/585
9,325,082 B2 * 4/2016 Furukawa ..... H01R 4/188
9,570,840 B2 * 2/2017 Morikawa ..... H01R 4/62
9,780,462 B2 * 10/2017 Nakata ..... H01R 4/185
2005/0221691 A1 10/2005 Li
2005/0227551 A1 * 10/2005 Tabata ..... H01R 13/113 439/852
2005/0266727 A1 * 12/2005 Yamaguchi ..... H01R 9/0518 439/585
2010/0035485 A1 * 2/2010 Okamura ..... H01R 4/185 439/877
2012/0329341 A1 * 12/2012 Morikawa ..... H01R 4/185 439/866
2014/0220835 A1 * 8/2014 Seipel ..... H01R 4/185 439/877
2015/0380834 A1 * 12/2015 Seipel ..... H01R 4/188 439/877
2017/0005417 A1 * 1/2017 Aoki ..... H01R 4/62

* cited by examiner

WIRE WITH A CRIMPED TERMINAL

BACKGROUND

Field of the Invention

This specification relates to a wire with terminal and a terminal.

Description of the Related Art

Conventionally, a wire with terminal in which a terminal is crimped and connected to an end of a wire is known. The wire with terminal of this type includes a wire barrel to be crimped to a core exposed from a coating of a wire and an insulation barrel to be crimped to the coating of the wire. However, merely crimping the wire barrel and the insulation barrel to the wire, may not be sufficient to prevent the wire from being detached from the terminal if the wire is pulled or if an impact is applied to the wire with terminal from outside.

Accordingly, Japanese Unexamined Patent Publication No. 2010-102853 discloses a terminal fitting that is crimped and connected to a wire by crimping an insulation barrel to a rubber plug externally fit on the wire to obtain an enhanced holding force for holding the rubber plug on the terminal fitting. In this terminal fitting, a recessed groove or through hole is provided in an inner surface (surface to be crimped) of the insulation barrel. When the insulation barrel is crimped to the rubber plug, the rubber plug penetrates into this recessed groove or through hole, thereby enhancing a holding force for holding the rubber plug on the terminal fitting.

In recent years, small diameter wires have been manufactured for saving weight in field of wiring harnesses of automotive vehicles and the like, and high-strength aluminum alloy compatible with small diameter wires has been employed. A small diameter wire using such aluminum alloy has a low impact strength. Even if the terminal fitting disclosed in Japanese Unexamined Patent Publication No. 2010-102853 is employed, the rubber plug and the coating penetrating into the recessed groove or through hole may be detached depending on the magnitude of an impact applied to the wire with terminal from outside. Thus, it is required to enhance impact strength of the wire with terminal.

The terminal and the wire with terminal disclosed in this specification was created in view of the above problem and aims to enhance impact strength.

SUMMARY

This specification is directed to a wire with terminal including a wire in which a core is covered with a coating, and a terminal. The terminal includes a wire barrel to be crimped to the core exposed from the coating of the wire and an insulation barrel to be crimped to the coating of the wire so that the wire extends rearward from the terminal. A recess is provided in a surface of the insulation barrel to be crimped and an opening of the recess is shaped to become narrower toward a rear end.

The insulation barrel of the above-described terminal is crimped to the coating of the wire so that a part of the coating fastened by crimping partially penetrates into the recess provided in the insulation barrel. The opening of the recess is shaped to become narrower toward the rear end. Thus, even if a force is applied in a direction to detach the wire from the terminal, i.e. in a direction to pull the wire rearward, the coating penetrating into the recess moves rearwardly of the recess to be compressed and hardened and becomes less likely to come out of the recess as the wire is pulled more rearward. Thus, in the above-described wire with terminal, even if the wire is pulled rearwardly by an impact applied from outside, the detachment of the wire from the terminal can be suppressed and impact strength can be enhanced.

Plural recesses may be provided in the surface of the insulation barrel to be crimped. According to this configuration, the amount of the insulation coating penetrating into the recess can be increased as compared to a configuration in which one recess is provided in the surface of the insulation barrel to be crimped. Thus, the detachment of the wire from the terminal can be suppressed and impact strength of the wire with terminal can be enhanced.

The opening of the recess may have a triangular shape. According to this configuration, the specific shape of the opening of the recess shaped to become narrower toward the rear side can be provided.

This specification is directed to a terminal from which a wire is to extend rearward. The terminal includes an insulation barrel to be crimped to a coating of the wire. A recess is provided in a surface of the insulation barrel to be crimped and an opening of the recess is shaped to become narrower toward a rear side.

In the above-described terminal, the insulation barrel is crimped to the coating of the wire. Thus a part of the coating fastened by crimping partially penetrates into the recess provided in the insulation barrel. The opening of the recess is shaped to become narrower toward the rear. Therefore, even if a force is applied in a direction to detach the wire from the terminal, i.e. in a direction to pull the wire rearward, the coating penetrating into the recess moves rearwardly of the recess to be compressed and hardened and becomes less likely to come out of the recess as the wire is pulled more rearwardly. Thus, with the above-described terminal, even if the wire is pulled rearward by an impact applied from outside, the detachment of the wire can be suppressed and impact strength can be enhanced.

According to this specification, it is possible to enhance impact strength.

DETAILED DESCRIPTION

Figure 1:
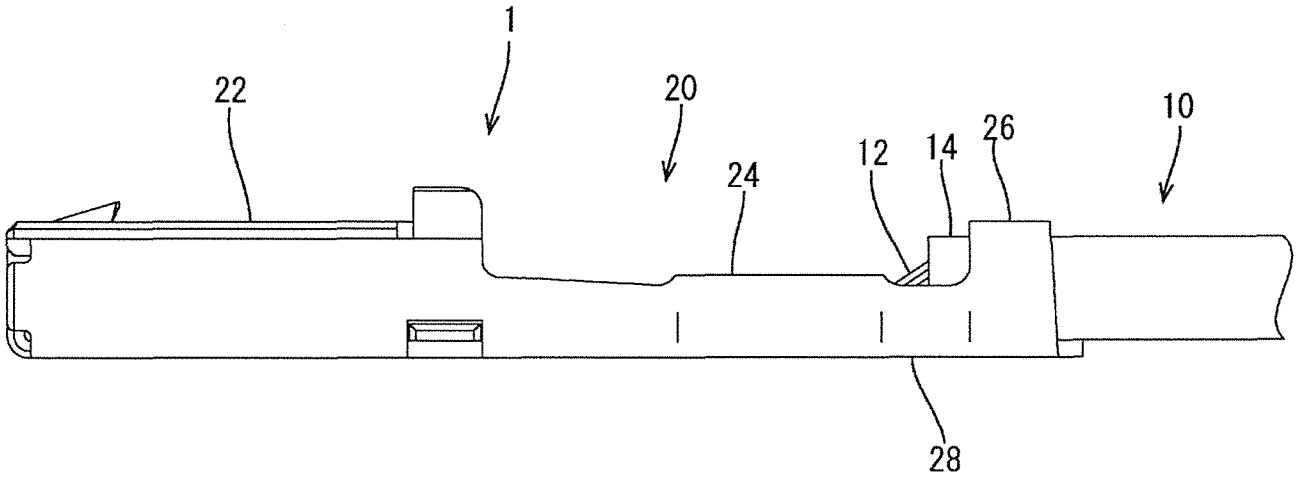
FIG. 1 is a side view of a wire with terminal according to a first embodiment.

A first embodiment is described with reference to FIGS. 1 to 4. A wire with terminal 1 shown in FIG. 1 is illustrated in the first embodiment. Note that, in the following description, an upper side in the side view and the section is referred to as an upper side of the wire with terminal 1, a left side in the side view, each plan development and the plan view is referred to as a front side of the wire with terminal 1, and a lower side in the side view and a right side in the section are referred to as a right side of the wire with terminal 1.

As shown in FIG. 1, the wire with terminal 1 of the first embodiment includes a wire 10 extending in a front-rear direction and having a circular cross-section, and a terminal 20 crimped and connected to the wire 10. The wire 10 is composed of a core 12 formed of a plurality of metal thin wires (e.g. strands using high-strength aluminum alloy compatible with small diameter wires) and an insulation coating 14 (an example of a coating) covering the core 12. The insulation coating 14 is stripped at a front end part of the wire 10 to expose the core 12. In the wire with terminal 1, the wire 10 extends rearwardly of the terminal 20 with the terminal 20 crimped and connected to the wire 10.

Figure 2:
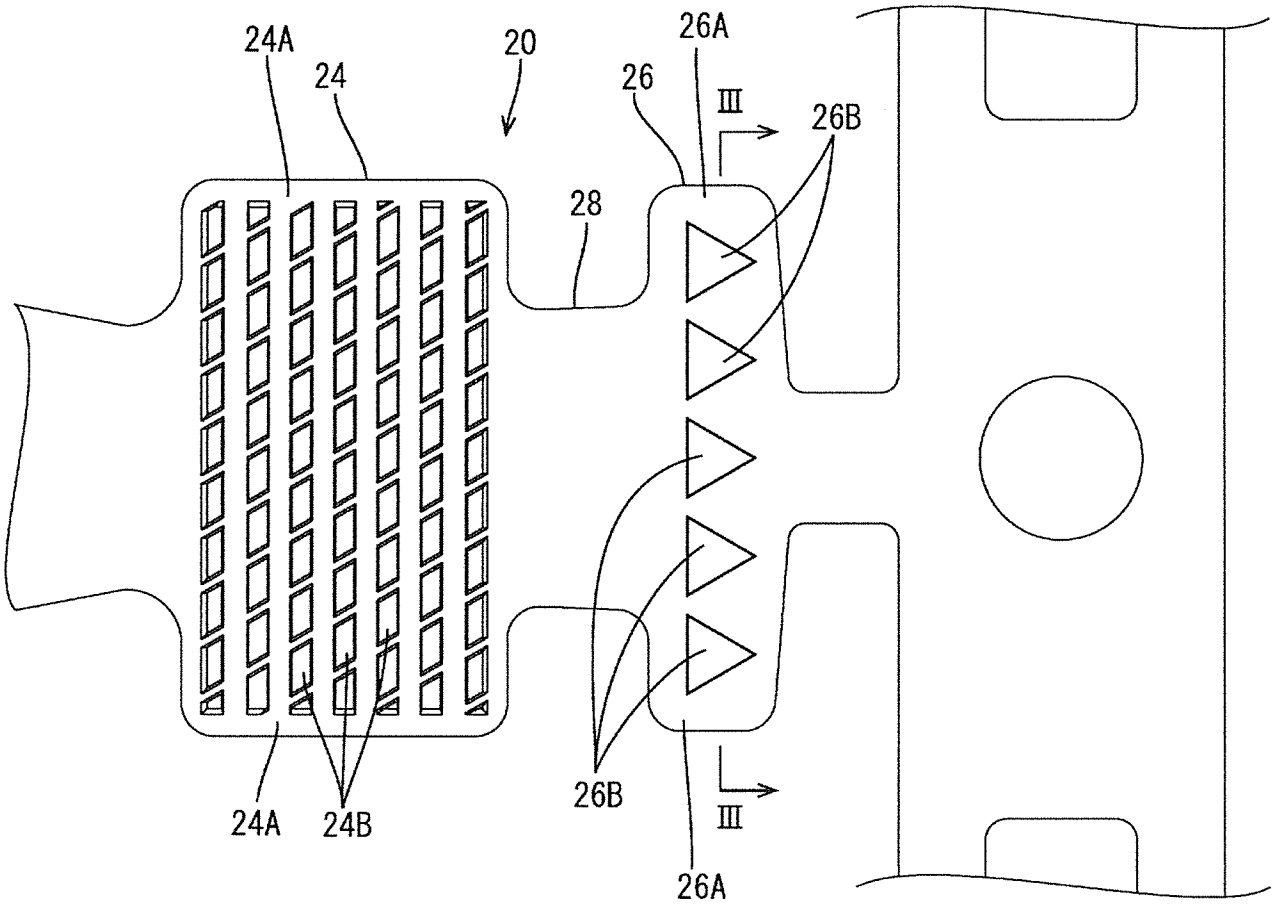
FIG. 2 is a plan development of a terminal.

The terminal 20 is formed by stamping a base material made of copper alloy and applying bending and the like. As shown in FIGS. 1 and 2, the terminal includes a box-shaped portion 22, a wire barrel 24 to be connected to the core 12 of the wire 10, an insulation barrel 26 to be connected to the insulation coating 14 of the wire 10 and a linking portion 28 linking between the wire barrel 24 and the insulation barrel 26. The box-shaped portion 22 is formed into a rectangular tubular box shape and a tab of an unillustrated male terminal is inserted therein.

The wire barrel 24 includes two wire barrel pieces 24A that extend in a lateral direction. These wire barrel pieces 24A are crimped to be wound inwardly with respect to the core 12 exposed from the insulation coating 14 at the front end part of the wire 10. Note that recessed serrations 24B are provided on a surface (inner surface) of the wire barrel 24 to be crimped to the core 12 of the wire 10 for ensuring good conduction with the core 12 and enhancing a holding force for holding the core 12.

The insulation barrel 26 is provided behind the wire barrel 24 across the linking portion 28, and includes two insulation barrel pieces 26A extending in the lateral direction. The insulation barrel 26 is crimped to the insulation coating 14 of the wire 10 by crimping these insulation barrel pieces 26A to the outer periphery of the wire 20. Note that, as shown in FIG. 2, lateral dimensions of the wire barrel 24 and the insulation barrel 26 are substantially equal in a state before the terminal 20 is crimped to the wire 10.

Figure 3:
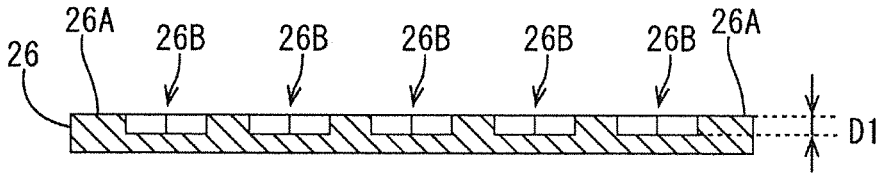
FIG. 3 is a section showing a cross-sectional configuration along in FIG. 2.

As shown in FIGS. 2 and 3, five recesses 26B are provided in a surface (inner surface) of the insulation barrel 26 to be crimped to the insulation coating 14 of the wire 10. These recesses 26B are provided side by side at equal intervals in the lateral direction and have the same size and same shape. Each recess 26B has a depth D1 (see FIG. 3) of, e.g. 0.5 mm, and is shaped to narrow an opening thereof toward a rear side. Specifically, the opening of each recess 26B has an equilateral triangular shape, a front side of which extends in the lateral direction and the other two sides of which are located behind the front side, in a plan view shown in FIG. 2.

Figure 4:
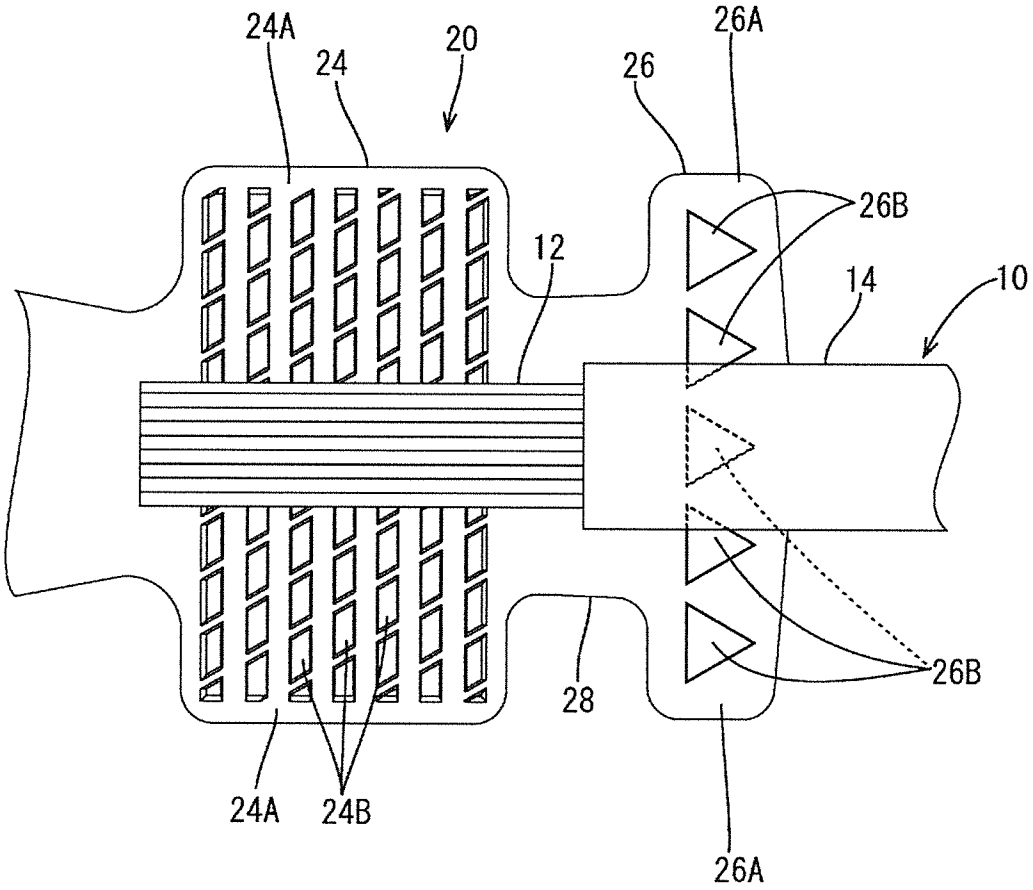
FIG. 4 is a plan view showing the terminal and a wire placed on the terminal in a developed state.

The wire with terminal 1 of the first embodiment is configured as described above. Next, functions of the wire with terminal 1 are described. In the process of manufacturing the wire with terminal 1, the front end part of the wire 10 is placed on the terminal 20 in a state before crimping, i.e. in a state where the wire barrel pieces 24A and the insulation barrel pieces 26A are open (developed state), as shown in FIG. 4 (showing each barrel 24, 26 in a substantially planar developed state). At this time, the core 12 of the wire 10 is disposed on the inner surface of the wire barrel 24 and a part of the linking portion 28 and the insulation coating 14 of the wire 10 is disposed on a remaining part of the linking portion 28 and the inner surface of the insulation barrel 26.

Subsequently, the wire barrel 24 is crimped to the core 12 of the wire 10 by crimping the wire barrel pieces 24A and the insulation barrel 26 is crimped to the insulation coating 14 of the wire 10 by crimping the insulation barrel pieces 26A. When the wire barrel 24 is crimped to the core 12, each serration 24B provided on the surface of the wire barrel 24 to be crimped bites into the core 12 to destroy an oxide film on the surface of the core 12 to ensure good conduction between the core 12 and the wire barrel 24.

When the insulation barrel 26 is crimped to the insulation coating 14, a part of the insulation coating 14 fastened by crimping partially penetrates into each recess 26B provided in the insulation barrel 26. The opening of each recess 26B becomes narrower toward the rear. Thus, even if a force is applied in a direction to detach the wire 10 from the terminal 20, i.e. in a direction to pull the wire 10 rearward after the insulation barrel 26 is crimped, the insulation coating 14 penetrating into each recess 26B moves rearward of each recess 26B to be compressed and hardened and becomes less likely to come out of each recess 26B as the wire 10 is pulled more rearward.

Thus, in the wire with terminal 1 of the first embodiment, a holding force for holding the wire 10 on the terminal 20 is sufficiently enhanced and, even if the wire 10 is pulled rearward by an impact applied from outside, the detachment of the wire 10 from the terminal 20 can be suppressed and impact strength can be enhanced.

The recesses 26B are provided in the surface of the insulation barrel 26 to be crimped in the wire with terminal 1 of the first embodiment. Thus, the amount of the insulation coating 14 penetrating into the recesses 26B can be increased as compared to a configuration in which one recess 26B is provided in the surface of the insulation barrel 26 to be crimped. Thus, the detachment of the wire 10 from the terminal 20 can be suppressed.

A second embodiment is described with reference to FIG. 5. A wire with terminal according to the second embodiment differs from that of the first embodiment in the shape of an opening of each recess 126B provided on an insulation barrel 126 of a terminal 120. The other configuration is the same as in the first embodiment and, hence, is not described. Note that, in FIG. 5, parts denoted by reference numerals obtained by adding 100 to those of FIG. 2 are the same parts described in the first embodiment.

Figure 5:
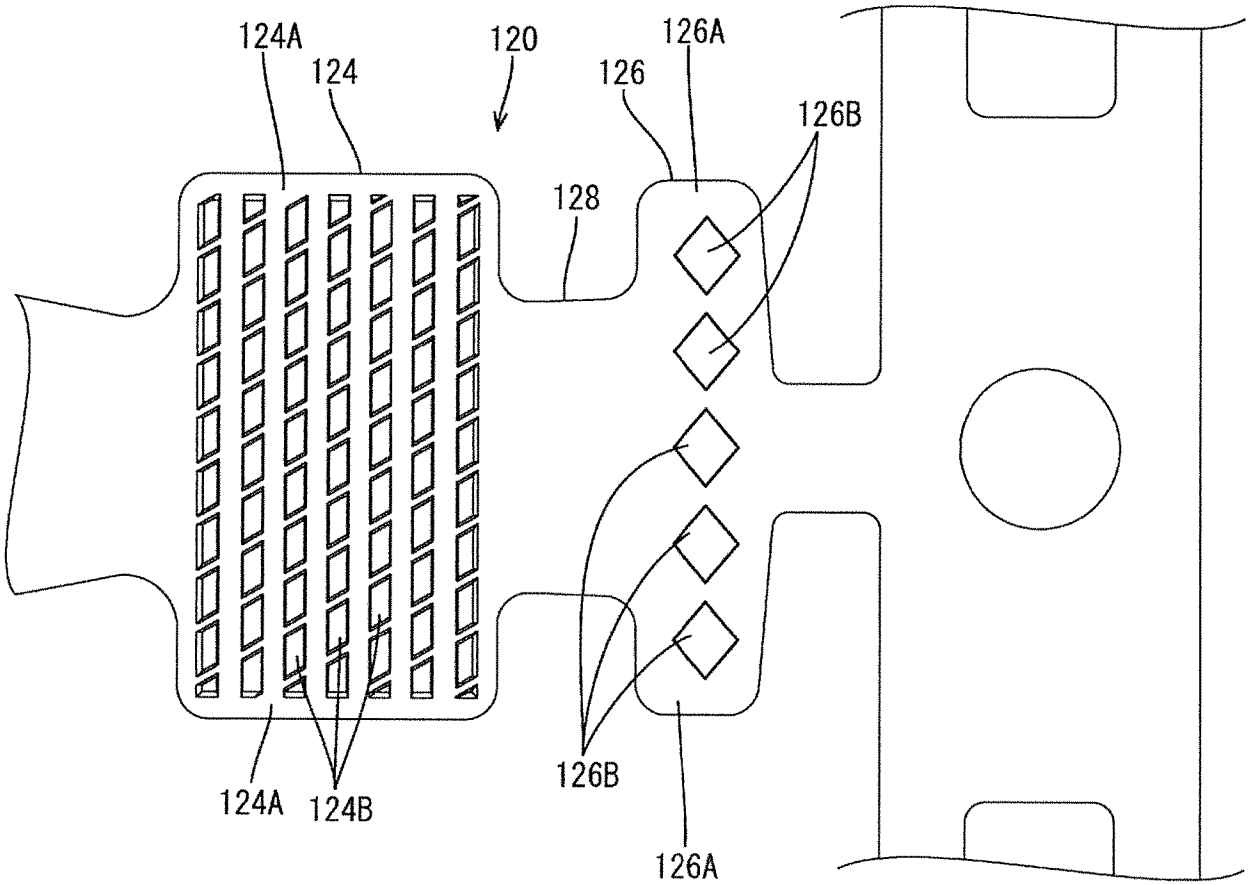
FIG. 5 is a plan development of a terminal in a second embodiment.

In the second embodiment, as shown in FIG. 5, five recesses 126B are provided in a surface of the insulation barrel 126 to be crimped to an insulation coating of a wire. These recesses 126B are provided side by side at equal intervals in a lateral direction and have the same size and same shape. The opening of each recess 126B has a rhombus shape, two diagonals of which respectively extend in a front-rear direction and the lateral direction, in a plan view shown in FIG. 5. Thus, the opening of each recess 126B becomes narrower toward a rear side.

In the wire with terminal of the second embodiment, even if the opening of each recess 126B has a rhombus shape, as described, this opening is shaped to become narrower toward the rear side. Thus, as in the first embodiment, even if a force is applied in a direction to pull the wire rearwardly, the insulation coating penetrating into each recess 126B moves rearward of the recess 126B to be compressed and hardened and becomes less likely to come out of the recess 126B as the wire is pulled more rearward. Thus, even if the wire is pulled rearward by an impact applied from outside, the detachment of the wire from the terminal can be suppressed and impact strength can be enhanced.

A third embodiment is described with reference to FIG. 6. A wire with terminal according to the third embodiment differs from that of the first embodiment in the shape of an opening of each recess 226B provided in an insulation barrel 226 of a terminal 220. The other configuration is the same as in the first embodiment and, hence, not described. Note that, in FIG. 6, parts denoted by reference numerals obtained by adding 200 to those of FIG. 2 are the same parts described in the first embodiment.

Figure 6:
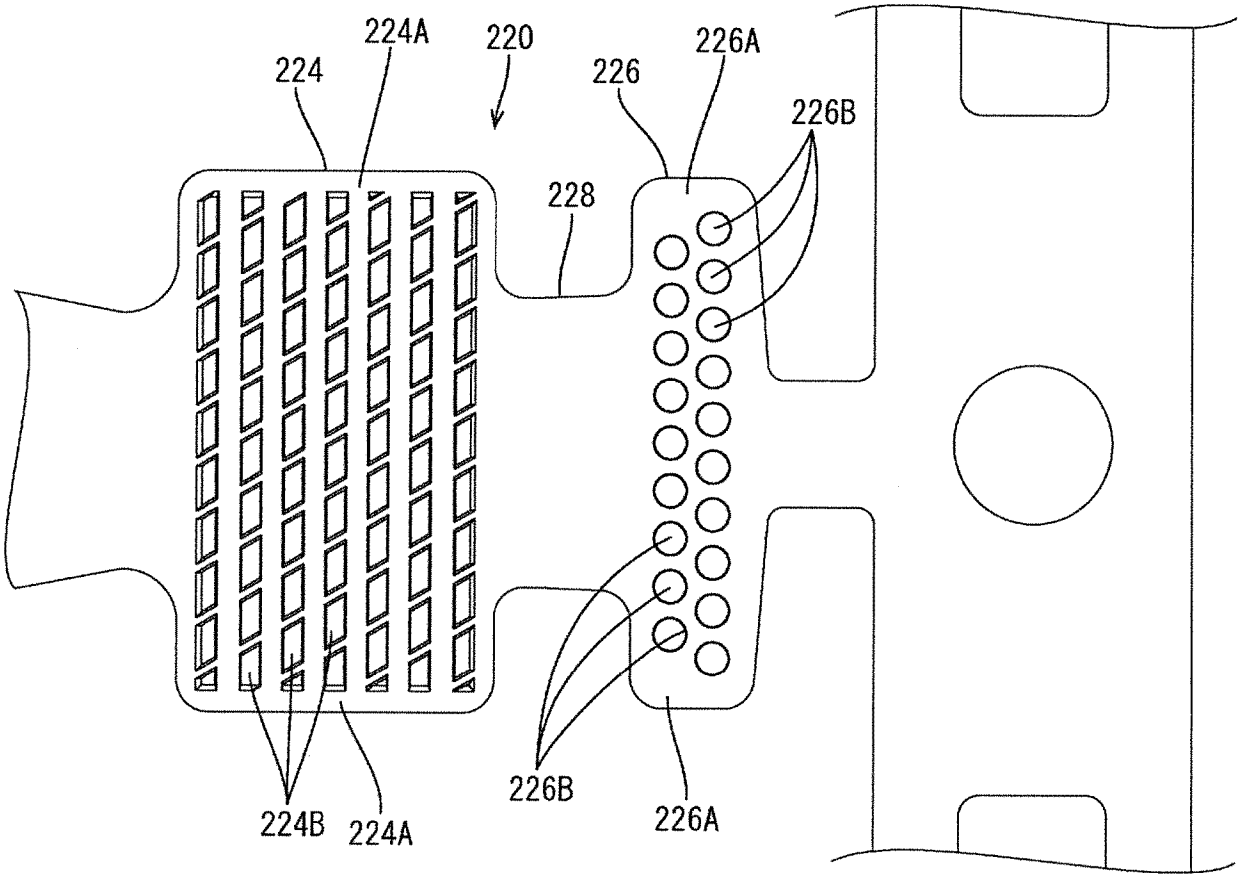
FIG. 6 is a plan development of a terminal in a third embodiment.

In the third embodiment, as shown in FIG. 6, plural recesses 226B are provided in a surface of the insulation barrel 226 to be crimped to an insulation coating of a wire. These recesses 226B are provided side by side at equal intervals in a lateral direction in an offset arrangement in front and rear rows, and have the same size and same shape. The opening of each recess 226B has a circular shape in a plan view shown in FIG. 6. Thus, the opening of each recess 226B becomes narrower toward a rear side.

In the wire with terminal of the third embodiment, even if the opening of each recess 226B has a circular shape, as described, this opening becomes narrower toward the rear. Thus, as in the first embodiment, even if a force is applied in a direction to pull the wire rearwardly, the insulation coating penetrating into each recess 226B moves rearward of the recess 226B to be compressed and hardened and becomes less likely to come out of the recess 226B as the wire is pulled more rearward. Thus, even if the wire is pulled rearward by an impact applied from outside, the detachment of the wire from the terminal can be suppressed and impact strength can be enhanced.

Modifications of each of the above embodiments are listed below.

Although the opening of each recess provided in the insulation barrel of the terminal has a triangular, rhombus or circular shape in each of the above embodiments, the shape of the opening of each recess is not limited. Further, the opening of each recess may have a polygonal shape having five or more sides.

Although the plurality of recesses provided in the insulation barrel of the terminal have the same size and same shape in each of the above embodiments, the respective recesses may be of different sizes or the openings of the respective recesses may be of different shapes.

Although the recesses are provided in the insulation barrel of the terminal in the each of the above embodiments, one recess may be provided on the insulation barrel of the terminal.

Although the core is exposed from the insulation coating at the front end part of the wire in each of the above embodiments, the core may be exposed from the insulation coating in an intermediate part of the wire.

Although the respective embodiments are described in detail above, these are merely illustrative and not intended to limit the scope of claims. The techniques described in the scope of claims include various modifications and alterations of the specific examples illustrated above.

LIST OF REFERENCE SIGNS

1 . . . wire with terminal
10 . . . wire
12 . . . core
14 . . . insulation coating
20, 120, 220 . . . terminal
22 . . . box-shaped portion
24, 124, 224 . . . wire barrel
24A, 124A, 224A . . . wire barrel piece
24B, 124B, 224B . . . serration
26, 126, 226 . . . insulation barrel
26A, 126A, 226A . . . insulation barrel piece
26B, 126B, 226B . . . recess
28, 128, 228 . . . linking portion

The invention claimed is:

1. A wire with terminal, comprising:

the wire having a core that is covered with a coating; and the terminal extending in forward and rearward directions and including a wire barrel crimped to the core exposed from the coating of the wire, an insulation barrel rearward of the wire barrel and crimped to the coating of the wire, and a linking portion linking between the wire barrel and the insulation barrel, wherein:

the insulation barrel includes first and second insulation barrel pieces projecting in opposite directions transverse to the forward and rearward direction and an inner surface facing the wire, a plurality of recesses formed in the inner surface of the insulation barrel and arranged side-by-side in the direction transverse to the forward and rearward direction, each of the recesses have a triangular opening that narrows from a forward end towards a rearward end, and the first and second insulation barrel pieces crimped to the coating of the wire so that the coating of the wire penetrates the plurality of recesses.

2. The terminal of claim 1, wherein the recesses do not break through the insulation barrel from the inner surface to the outer surface.

3. The terminal of claim 1, wherein the insulation barrel further includes an outer surface opposite the inner surface, a thickness dimension between the inner and outer surfaces at positions corresponding to the plurality of recesses is less than thickness dimensions at locations on the insulation barrel spaced from the recesses.

4. The terminal of claim 3, wherein the outer surface of the insulation barrel is continuous without recesses formed therein.

* * * * *